United States Patent [19]

Carlson et al.

[11] 4,017,120

[45] Apr. 12, 1977

[54] PRODUCTION OF HOT BRINES FROM LIQUID-DOMINATED GEOTHERMAL WELLS BY GAS-LIFTING

[75] Inventors: Elwood L. Carlson, Clayton; Albert A. Gunkler, Walnut Creek; Conrad O. M. Miller, Concord; H. Hunter Paalman, Walnut Creek, all of Calif.

[73] Assignee: The Dow Chemical Company, Midland, Mich.

[22] Filed: Nov. 28, 1975

[21] Appl. No.: 636,192

[52] U.S. Cl. ..... 299/5; 166/314; 299/7

[51] Int. Cl.[2] ..... E21B 43/00; E21B 43/28

[58] Field of Search ..... 299/4, 5, 7; 165/45; 166/314

[56] References Cited

UNITED STATES PATENTS

| | | | |
|---|---|---|---|
| 344,266 | 6/1886 | Gotham | 166/314 |
| 1,520,052 | 12/1924 | Conrader | 166/314 X |
| 1,649,385 | 11/1927 | Blumenberg, Jr. | 299/5 |
| 1,787,972 | 1/1931 | Doherty | 166/314 X |
| 1,899,497 | 2/1933 | Doherty | 166/314 X |
| 3,326,606 | 6/1967 | Banks | 299/5 |
| 3,372,753 | 3/1968 | Tuttle | 166/314 |
| 3,393,733 | 7/1968 | Kuo et al. | 299/5 X |
| 3,757,516 | 9/1973 | McCabe | 165/45 X |
| 3,782,468 | 1/1974 | Kunada | 166/267 |
| 3,792,902 | 2/1974 | Towell et al. | 299/5 |
| 3,880,238 | 4/1975 | Tham et al. | 299/5 X |

*Primary Examiner*—Stephen J. Novosad
*Assistant Examiner*—George A. Suchfield
*Attorney, Agent, or Firm*—Robert R. Stringham

[57] ABSTRACT

Hot brines containing dissolved gases are produced from liquid-dominated geothermal wells by utilizing lift gases of essentially the same composition as said dissolved gases. The lift gas is separated from the produced brine and recycled. Heat is abstracted from the separated brine, which may be returned to the aquifer, processed for its mineral content or discarded. The gas lift is carried out under temperature and pressure conditions such that precipitation of minerals from the brine does not occur in the well bore. The problems which would result from the use of oxygen-containing and/or brine-soluble inert gases for the lifting operation are avoided. The problems attendant upon production of hot brines by pumping are also avoided.

5 Claims, 2 Drawing Figures

PRODUCTION OF HOT BRINES FROM LIQUID-DOMINATED GEOTHERMAL WELLS BY GAS-LIFTING

BACKGROUND OF THE INVENTION

1. Field of the Invention

This invention relates to production of geothermal brines and, more specifically, to utilization of gases dissolved in and associated with such brines, to effect such production. The invention also relates to the recovery of heat energy, water and chemicals from geothermal aquifers.

2. Description of the Prior Art

The prior art pertinent to the present invention is believed to be limited to two categories: (1) production of geothermal brines (by means other than gas-lifting) and (2) gas-lifting of water and/or petroleum from wells at ordinary subterranean temperatures.

The known art(s) involved in the utilization of geothermal brines is summarized in number 12 of a series of publications by the Unesco Press on earth sciences; Geothermal Energy, Review of Research and Development (The Unesco Press, 7 Place de Fontenoy, 75700 Paris, France; (1973)).

Brines obtained from naturally heated aquifers have been utilized for various purposes since at least as early as ancient Rome. In recent times, geothermal brines having temperatures up to about 120° C. have been used, or proposed to be used, for such varied purposes as the following (listed in order of increasing temperature requirements): fish hatching or farming, de-icing, operation of mines and mills in cold climates, swimming pools, biodegradation processes, fermentation, soil warming, therapeutic baths, mushroom growing, greenhouse operations, animal husbandry, energization of refrigeration equipment, space heating, drying of fish, seaweeds, grasses, vegetables, etc., wood processing, drying and curing of concretes and evaporation or distillation of water from brackish or saline water supplies.

The most dramatic and best known use for geothermal energy is electric power generation, as practiced in Italy, Japan, Iceland, New Zealand, Mexico and the United States (California). In some locations, "dry" steam, produced as such from geothermal wells, is employed for this purpose. In other locations, wet steam, present as such in a geothermal formation or formed by flashing of hot brines, is used. In the latter instance, flashing may occur in the formation, in the well or after egress from the well head, depending on formation conditions and the mode of operation. Flashing necessarily entails a temperature drop and an increase in solute concentration in the liquid phase. Thus, precipitation of dissolved minerals often is consequent upon flashing. The resulting deposits constitute an expensive nuisance in surface installations but are a much more serious problem when formed within the formation and/or the well(s). Consequently, it will frequently be desirable to produce a geothermal brine under sufficient pressure that flashing prior to egress is largely avoided. However, geothermal formation pressures usually are not high enough to permit "self production" of brines without at least partial flashing and some "external" lifting agent will ordinarily be required.

Downhole pumps have been used for lifting geothermal brines but considerable difficulties in maintaining bearing lubrication and avoiding electrical problems have been experienced.

It is thus apparent that a better method for lifting geothermal brines which are not under sufficient autogenous pressure to be self-lifting without flashing is needed. To be practical and economic, such a method must not require the use of oxygen-containing gases or gases which are both soluble and expensive.

A complicating factor in any consideration of gas-lifting geothermal brines is the fact that such brines generally are saturated (and associated) with gases, such as carbon dioxide and hydrogen sulfide, which affect the chemical nature and solubilities of certain mineral components of the brines. Precipitation of such components may result if the composition or the pressure on the gas phase of the total geothermal fluid is altered. An additional problem is that severe corrosion problems can be expected to result if an oxygen-containing gas, such as air, is employed for lifting. A further problem is that solubility losses of any inert gases which might be employed for lifting could be prohibitively expensive.

The practice of gas-lifting has heretofore been largely restricted to the use of air, i.e., to "air lift pumping", for obvious reasons of availability and cost. The state of this art has changed little in recent years and is as described by K. E. Brown; "Gas Lift Theory and Practice", Petroleum Publishing Co., (1967).

Air lifting used to be a popular method of pumping liquids but has largely been displaced in many previously favored applications by deep-well (down-hole) centrifugal pumps. The latter pumps are more economical and can handle corrosive and erosive liquids when appropriately designed and fabricated of suitable materials. However, simplicity and the absence of moving parts in contact with the liquid to be pumped remain as outstanding advantages of gas-lifting, particularly where economic considerations are not paramount.

OBJECTS OF THE INVENTION

A primary object of the present invention is to provide a method of gas-lifting geothermal brines which are not under sufficient autogenous pressure to be self-lifting without the occurrence of flashing.

Another object is to provide a method of producing such brines which avoids the problems attendant upon the use of down-hole pumps.

An additional object is to provide a method of gas-lifting such brines which obviates the problems resulting from the use of air or gases which, though inert, are sufficiently brine-soluble and expensive to be uneconomic.

Yet another object is to provide a method of producing geothermal brines under temperature conditions such that sub-surface precipitation of dissolved minerals does not result.

A further object is to provide a method of producing a geothermal brine which is in solution equilibrium with a gas phase which includes not only steam but other components, the concentrations of which in the liquid phase are critical to non-precipitation of minerals therefrom, whereby the composition of the gas phase is kept essentially constant.

Still another object is to provide a method of producing a brine of the latter type in which a lifting gas is employed which is oxygen-free but is readily available at no substantial cost.

An additional object is to provide a method of producing a brine of the preceding type without altering or disproportionately depleting the gas phase in the aquifer from which the brine is to be produced.

SUMMARY OF THE INVENTION

The present invention is the method of producing from a subterranean formation a hot brine containing a dissolved gas and from which mineral precipitation will tend to occur if the composition of said gas in the brine is substantially altered, said method comprising gas-lifting said brine to the surface of the earth through a well bore communicating with said formation, using a gas of essentially the same composition as said dissolved gas, including steam, and discharging the resulting gas/brine mixture from said well against a back pressure which is maintained at a level not substantially lower than the vapor pressure exerted by the brine at the temperature prevailing at the point of introduction of the lift gas in said well, thereby preventing substantial subsurface flashing or stripping of the brine.

In a preferred mode of operation, the lift gas is separated from the produced gas/brine mixture and is repressurized and recycled to the gas-lifting operation.

In a particularly important mode of operation, the brine contains a dissolved mineral which will tend to precipitate if the temperature of the brine is lowered below the formation temperature by more than about x degrees, and heat is recovered from the brine, after the lift-gas is separated from it, (preferably indirect heat exchange) is an amount such that the temperature of the brine is lowered below the formation temperature by less than x degrees.

In the preceding mode of operation, the heat-depleted brine optionally is recycled to the geothermal aquifer through one or more wells sufficiently far from any production well to avoid substantial cooling of brine still to be produced, or is discarded.

In an alternative procedure, additional heat is removed from the produced brine so that it's temperature is decreased by a total of more than x degrees, and the resulting cooled brine is worked up to recover at least those mineral components precipitated as a result of the additional heat removal, or is discarded.

BRIEF DESCRIPTION OF THE DRAWINGS

FIG. 2 also depicts the main elements of a minimal surface installation for separation and recycle of the lift gas.

DETAILED DESCRIPTION

Figure 1:
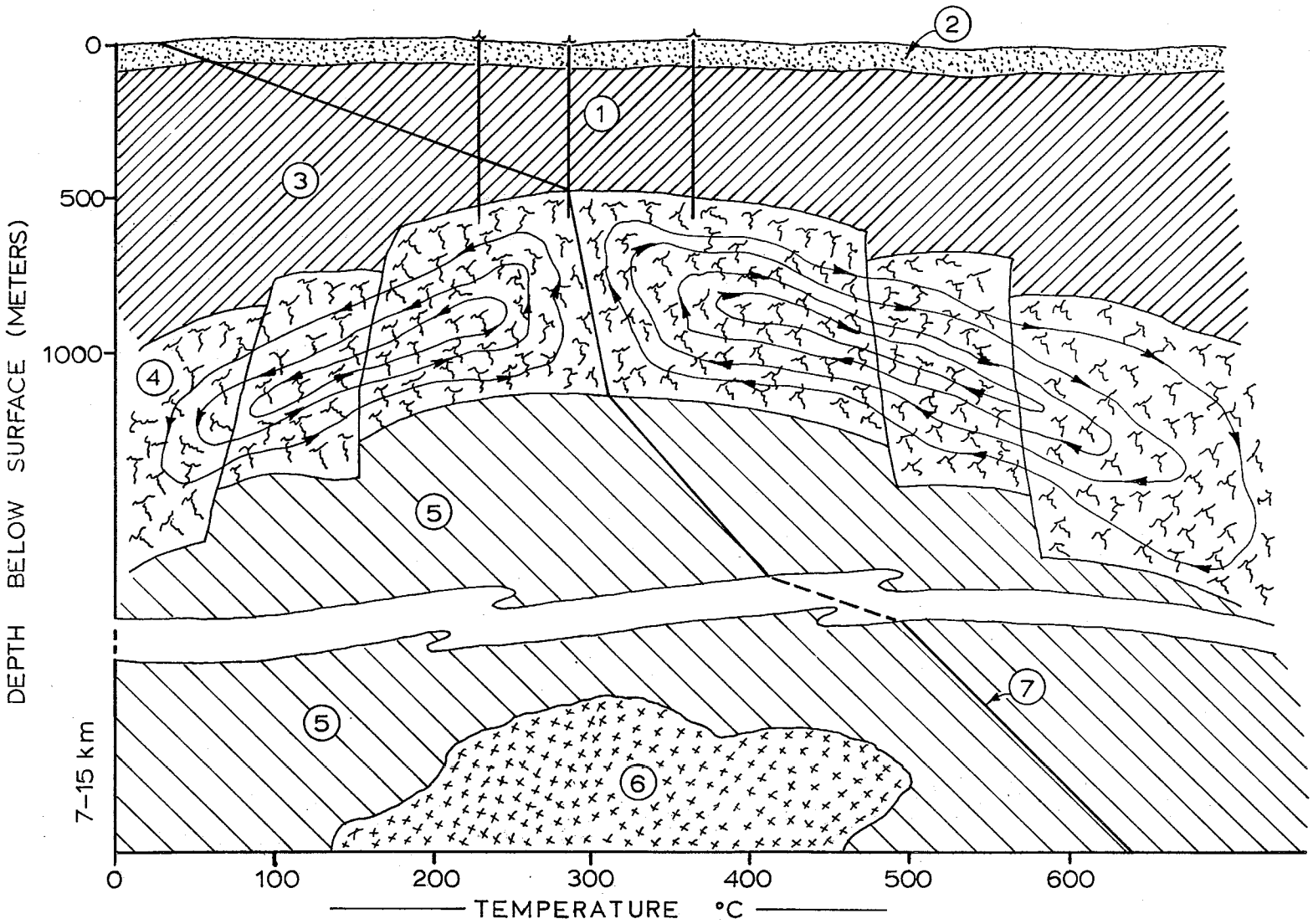
FIG. 1 is a vertical cross-section of an idealized geothermal field, the aquifer of which is penetrated by several well bores.

Referring to FIG. 1, a well-bore 1 is shown penetrating a layer 2 of surface sediments, a thickness of relatively impermeable cap rock 3 and an aquifer 4, the latter overlying bed rock 5 and a magmatic instrusion 6. The temperature gradient with depth is shown by line 7. Convection currents within the aquifer are indicated by generally concentric, closed loops (not numbered).

Figure 2:
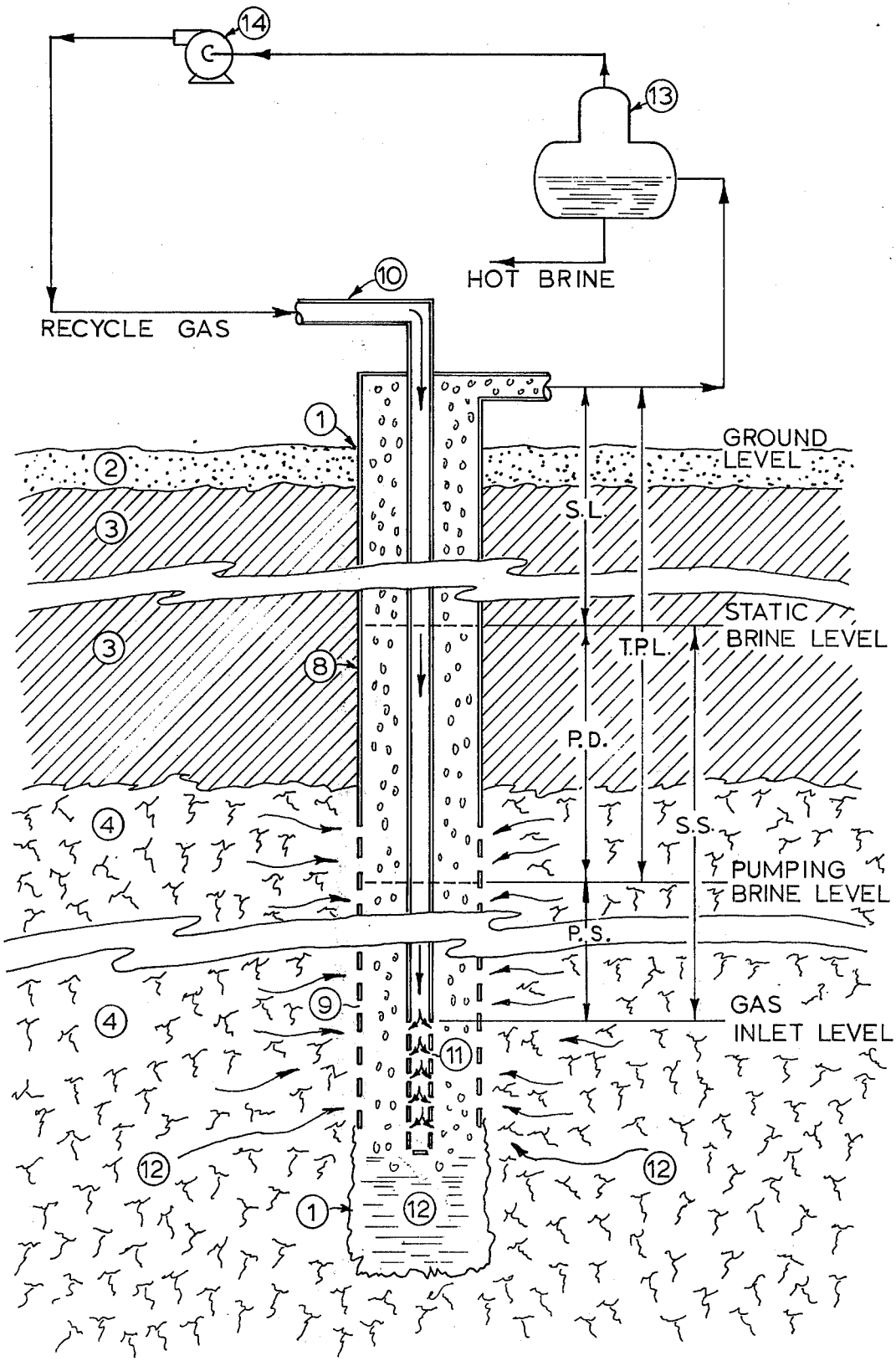
FIG. 2 is a vertical cross-section, in enlarged scale, of one of the well bores (of FIG. 1) and the immediately surrounding portions of the strata penetrated by the bore.

Referring to FIG. 2, elements 1 through 4 are as in FIG. 1. A well casing 8 is inserted in bore 1 and is pierced by openings (slots or perforations) 9 through which the brine 12 enters from the aquifer 4. Gas input tubing 10 passes through appropriate well-head fittings (not shown in detail or numbered) and extends nearly to the bottom of bore 1. In the Figure, the lower end of this tubing is shown as closed, the closure and adjacent wall sections being shown as pierced by openings 11. The produced brine/gas/steam mixture is passed to a separator 13 from which a hot brine stream is withdrawn and the gas and steam is taken overhead to a compressor 14. The compresses gas/steam mixture is recycled to the aquifer through gas inlet tube 10.

Terminology

The static lift (SL, in FIG. 2) is the vertical difference between the static brine level (the level of the brine surface in the well when no brine is being produced) and the above-ground level to which the brine must be raised for processing at the surface. The total pump lift (TPL) is equal to the static lift plus the pumping drawdown (PD), i.e., the amount that the brine level will have dropped when the brine is being pumped at a given rate. That is, TPL is the difference between the brine level when pumping and the processing level. The static submergence (SS) is the vertical difference between the static brine level and the pumping gas inlet level. The pumping submergence (PS) is less than the static submergence by an amount equal to the drawdown. That is, the pumping submergence is equal to the vertical distance between the pumping brine level and the gas inlet level.

In order to specify initial operating parameters and size equipment for development of a given geothermal field, empirical data obtained from at least one test well will usually be required. Methods of making the necessary measurements in such a well are described by N. D. Dench at pages 85–95 of "Geothermal Energy", cited earlier herein. In addition to test well data, geophysical and geochemical data (obtained as described by C. J. Banwell at page 42 and by G. E. Sigvaldason at pages 49–58, respectively, of the same reference) are of considerable value, not only for selecting a test well site, but also in conjunction with test well data for specifying operating parameters and for selecting and sizing equipment.

Particularly important for the latter purpose is a knowledge of the chemical compositions of both the brine and the gases associated therewith in the aquifer to be exploited. Analyses of brines from geothermal aquifers in Iceland, New Zealand, Chile, Taiwan and the U.S.A. (Yellowstone Park) have been reported. See page 50, "Geothermal Energy"; loc cit. The range of contents of various mineral constituents in these brines (temperatures 55°–220° C.) are given below.

| Material | Concentration Range, ppm |
|---|---|
| Li | 2.3–14.2 (often not determined) |
| Na | 1.3–250 |
| K | 3.0–905 |
| Ca | 0.9–354 |
| Mg | 0–68 |
| F | 1.5–9.5 |
| Cl | 15.0–8,730 |
| Br | average 6.0 (usually not determined) |
| $SO_4$ | 28.0–3,730 |
| As | average 4.8 (usually not determined) |
| B | 4.3–131 |
| $NH_3$ | 0.2–30 |
| $HCO_3^-$ | 19.0–667 |
| $CO_3^=$ | average 70 |
| $H_2S$ | average 0.2 |

will be lower than the temperature of the gas/brine mixture reaching the surface during production. Thus, the pressure measured this way will be lower than the vapor pressure which will be exerted by the brine under dynamic conditions and allowance should be made for this fact.

It should be noted that the factor, 0.434, used to convert pressures to equivalent heads of water must be multiplied by the specific gravity, g, of the brine in order to apply the foregoing equations to gas-lifting of hot brines. The average temperature of the flowing gas/brine mixture in the well will be higher than the average temperature of the static brine column. Accordingly, the value of g used should allow for this difference.

In order to maintain the gas pipe outlet at pressure $p$ (defined as above), the compressor outlet pressure (the gas pipe input pressure) will have to be greater than $p$ by an amount equal to the pressure drop ($p_{f_1}$) due to friction within the gas pipe. Ordinarily, the gas pipe diameter and shape will be such that this friction loss will be relatively small. Allowance will also be necessary for the friction loss ($p_{f_2}$) developed by the gas/-brine mixture as it flows to the surface. This loss will effectively increase the total pumping lift required, as well as the gas pipe inlet pressure. Thus, in applying either of equations (1) and (2), the value of T.P.L. must include the discharge pressure and the latter friction loss and $p$ must include the discharge pressure and both of the preceding friction losses.

In summary, equation (2), for example, becomes $$V = \frac{T.P.L. + \left(\frac{p_d + p_{f_2}}{0.434\ g}\right)}{\frac{P_a + p_d}{0.434\ g}} \log_e \left(1 + \frac{S}{\frac{P_a + p_d}{0.434\ g}}\right)$$

or $$V = \frac{0.434\ g\ (T.P.L.) + p_d + p_{f_2}}{P_a + p_d} \log_e \left(1 + \frac{0.434\ g\ S}{P_a + p_d}\right) \quad (5)$$

where $p_d$ is the discharge or back pressure on the gas/brine mixture and $p_{f_2}$ is the friction loss in the conduit through which the mixture rises to the surface;

$$p_c = P_a + 0.434gS + p_d + p_f \quad (6)$$

where $p_{f_1}$ is the friction loss in the gas pipe and $p_c$ is the compressor discharge pressure; and $$\%\ \text{submergence} = A \exp\left[-B\left(T.P.L. + \frac{p_d + p_{f_2}}{0.434\ g}\right)\right] \quad (7)$$

According to a well known rule-of-thumb developed from air lift experience, the cross-sectional area (in square inches) of the conduit (the annular space between the gas-pipe 10 and the casing 8, in the arrangement of FIG. 2) carrying the gas/brine mixture to the surface should be equal to the brine discharge in gallons per minute, divided by a factor of from about 12 to 15.

Since the magnitude of the friction losses (for given casing and gas pipe dimensions) will depend on V (and on the brine production rate) a first approximation of V should be obtained by using (T.P.L. + $p_d$/0.434g) in place of T.P.L. and $(P_a + p_d)/(0.434g)$ in place of $H_a$, in equation (2). The friction losses $p_{f_1}$ and $p_{f_2}$ can then be estimated by conventional methods (see K. E. Brown, Gas Lift Theory and Practice; Petroleum Publishing Co., Tulsa, Okla., 2d. printing, 1973) of calculating such losses and a second approximation of V obtained using equation (6). Better values of $p_{f_1}$ and $p_{f_2}$ can then be calculated, and so on, until the difference between the value of V used to calculate $p_{f_1}$ and $p_2$ and the value of V obtained by using equation (6) becomes satisfactorily small.

There will generally be little point in attempting to obtain a perfect equality from equation (6) because the equation involves an unresolvable element of uncertainty. That is, the total pumping lift depends on the drawdown, which in turn depends on the resistance to brine flow within the formation at the contemplated production rate. The latter resistance cannot be predicted with much accuracy.

Accordingly, even the best values of V, $p$ and % submergence obtainable from equation (6) must be regarded merely as approximations and it may not be possible to establish a desired production rate unless provision is made in advance for adjusting the submergence (adjusting the depth of the gas outlet in the well).

Once a brine has been brought to the surface and separated from the lift gas, it can be utilized as a heat source by whichever of the several conventional methods appears to be most appropriate.

Heat may be transferred from the separated brine to a suitable working fluid for operation of a power generating device, in any conventional manner. The hot brine may be flashed to produce steam or may be subjected to direct or indirect heat exchange with a fluid such as isobutane, for example.

In ordinary practice, the lift-gas will be separated from the brine with as little pressure loss as possible, passed directly to a compressor with as little cooling as possible, recompressed and recycled to the outlet of the gas pipe in the well.

We claim:

1. The method of producing from a subterranean formation a hot brine containing a dissolved gas and from which mineral precipitation will tend to occur if the composition of said gas in the brine is substantially altered, comprising gas-lifting said brine to the surface of the earth, through a well bore communicating with said formation, using a gas of essentially the same composition as said dissolved gas, including steam, and discharging the resulting gas/brine mixture from said well against a back pressure which is maintained at a level not substantially lower than the vapor pres- -continued

| Material | Concentration Range, ppm |
|---|---|
| $SiO_2$ | 60.0–640 |
| pH | 1.6–9.26 |

According to Sigvaldason (loc. cit.), geothermal brines have been arbitrarily classified into several main types, according to their predominant mineral components:

1. Sodium chloride brines (the most common type in large aquifers) are generally neutral at depth but become somewhat alkaline upon losing steam and $CO_2$; the ratio of $Cl^-$ to $SO_4^=$ is high in these brines;
2. Acid sulphate/chloride brines, having relatively high ratios of bisulphate to chloride ions, are rare and their acidity is attributed to oxidation of sulphide to bisulphate, at depth.
3. Acid sulphate brines are common in fumaroles. Their acidity is attributed to oxidation of $H_2S$ to $H_2SO_4$ and their chloride contents are very low.
4. Calcium bicarbonate brines occur as warm springs, precipitate calcite and are too cool to be economically processable.

More than one type of brine can occur within a given geothermal system and the composition of the thermal gases (other than steam) associated with a given brine type can vary. Three main types of thermal gases are discernible:

1. High nitrogen content; little or none of active gases;
2. Very high $CO_2$ and minimal $H_2S$ and $H_2$ contents;
3. High contents of $H_2$, $H_2S$ and $CO_2$.

Other constituents of thermal gases are methane, Argon, ammonia and $H_3BO_3$.

The dependency of solubility equilibria between various mineral and gaseous components of brines on temperature and pressure (depth) is quite complex. Consequently, it is difficult to predict how much flashing or stripping of a given brine can be permitted to occur without experiencing in-well precipitation of silica, calcite, etc. Furthermore, operating parameters established for one well in a geothermal field may not necessarily be applicable to a second well. However, if essentially no flashing or stripping is allowed to occur in a test well, surface tests on the produced steam/gas/brine mixture will provide data from which initial operating conditions for the test well can be set. Also, operating conditions for the next well in the same field can at least be estimated from the data by those skilled in the art. Such data include the temperature drop (represented as x elsewhere herein) which cannot be exceeded if the brine is to be produced and processed without causing mineral precipitation to occur. The numerical value of x does not have to be, but desirably will be, determined before sustained brine production is attempted.

The delivered cubic feet of air (V) required to bring a gallon of water to the surface by ordinary air-lifting can be estimated using the following empirical formula, developed by the Ingersoll-Rand Co. from practice:

$$V = 0.8 \frac{T.P.L.}{C \log_e [(PS + 34)/34]} \quad (1)$$

where T.P.L. is the total pumping lift (see FIG. 2), PS is the pumping submergence and C is a constant which varies with the total pumping lift as shown in Table I below.

TABLE I

| T.P.L.-ft | 10–60 | 61–200 | 201–500 | 501–650 | 651–750 |
|---|---|---|---|---|---|
| C | 245 | 233 | 216 | 185 | 156 |

An alternative equation, introduced by Goodman and Purchas, may be used to calculate V for ordinary air lifting:

$$V = \frac{T.P.L.}{H_a} \log_e \left(1 + \frac{S}{H_a}\right) \quad (2)$$

where $H_a = P_a/0.434$, $P_a$ is atmospheric pressure and S and T.P.L. are defined as above. The value of V obtained by equation (2) is considered as about a minimum for operability and is usually multiplied by a factor of about 2 to 4 to ensure good (~70–80%) lifting efficiencies.

The absolute pressure, $p$, which must be applied to the lift gas is:

$$p = P_a + 0.434S \quad (3)$$

where S is the static submergence (SS in FIG. 2) at initiation of lift and is the pumping submergence (PS in FIG. 2) after lifting is established.

The percentage submergence, $S \times 100/S + T.P.L.$, decreases as the lifting requirement increases and can be calculated by the following equation:

$$S/T.P.L. = A^{(-B \times T.P.L.)} \quad (4)$$

where A and B are constants, the values of which vary with T.P.L. as follows:

| | |
|---|---|
| 185 ≥T.P.L. ≥25<br>A=5.2410<br>B=0.01081 | T.P.L. ≥185<br>A=2.8284<br>B=0.003466 |

In order to avoid sub-surface precipitation of dissolved minerals, it will usually be essential to maintain a back pressure (discharge pressure, $p_d$) on the gas/brine mixture which is at least high enough to ensure that steam flashing and stripping of dissolved gases does not occur to any substantial extent prior to egress from the well. On the other hand, economic considerations dictate operating at the lowest possible lift gas pressure, i.e., at the minimum pressure needed to force through the gas pipe and well the amount of gas required to produce the desired gallons per minute of brine. If the minimum discharge pressure $p_d$ which will prevent subsurface flashing is maintained, then both $H_a$ and the total pumping lift will have to be increased by a minimal amount equal to $p_d/0.434$ and $p$ (defined as above) will be equal to $P_a + 0.434S + P_d$. The minimum value of $p_d$ will be essentially equal to the vapor pressure exerted by the brine (including dissolved gases) at the temperature at the point of introduction of the lift gas in the well.

The vapor pressure of the brine to be produced can be estimated by closing down the well as soon as it is finished and allowing it to come to equilibrium. The temperature of the gas above the static brine column sure exerted by the brine at the temperature prevailing at the point of introduction of the lift gas in said well, thereby preventing substantial subsurface flashing or stripping of the brine.

2. The method of claim 1 wherein the lift gas is separated from the produced gas/brine mixture and is repressurized and recycled to the gas-lifting operation.

3. The method of claim 2 wherein said brine contains a dissolved mineral which will tend to precipitate if the temperature of the brine is lowered below the formation temperature by more than about x degrees and heat is recovered from the brine, after the lift-gas is separated from it, in an amount such that the temperature of the brine is lowered below the formation temperature by less than $x^{\circ}$.

4. The method of claim 3 wherein said heat is recovered from said brine by indirect heat exchange.

5. The method of claim 3 wherein (a) an additional amount of heat is also recovered from the brine, thereby lowering the temperature of the brine below the formation temperature by more than x degrees and causing precipitation of said mineral, and (b) the precipitated mineral is separated.

* * * * *

UNITED STATES PATENT OFFICE

CERTIFICATE OF CORRECTION

PATENT NO. : 4,017,120

DATED : April 12, 1977

INVENTOR(S) : E. L. Carlson et al.

It is certified that error appears in the above-identified patent and that said Letters Patent are hereby corrected as shown below:

Column 4, line 11, word "compresses" should be -- compressed -- ;

Column 7, above the equation at line 56, insert -- equation (4) becomes -- ;

Column 8, line 12, first word should be -- $p_{f_2}$ -- .

Signed and Sealed this

*twenty-sixth* Day of *July 1977*

[SEAL]

*Attest:*

RUTH C. MASON
*Attesting Officer*

C. MARSHALL DANN
*Commissioner of Patents and Trademarks*